United States Patent [19]

Haase

[11] Patent Number: 5,035,106

[45] Date of Patent: Jul. 30, 1991

[54] METHOD OF SEALING A VALVE TO AN AEROSOL CONTAINER

[75] Inventor: Franklin D. Haase, Ridge Farm, Ill.

[73] Assignee: CCL Industries, Willowdale, Canada

[21] Appl. No.: 449,525

[22] Filed: Dec. 12, 1989

[51] Int. Cl.[5] ..... B65B 3/02; B65B 31/04

[52] U.S. Cl. ..... 53/470; 53/488; 29/511; 29/512

[58] Field of Search ..... 53/470, 488, 487, 489, 53/353, 356, 330; 29/511, 512, 522.1

[56] References Cited

U.S. PATENT DOCUMENTS

| | | | |
|---|---|---|---|
| 1,585,820 | 5/1926 | Baum | 53/330 |
| 3,313,088 | 4/1967 | Chelle | 53/356 |
| 3,668,824 | 6/1972 | Solomonov et al. | 53/330 |
| 3,757,717 | 9/1973 | Bennett | 53/330 X |
| 3,848,318 | 11/1974 | Giuffredi | 53/470 X |
| 4,555,208 | 11/1985 | Houdayer et al. | 53/488 X |
| 4,813,576 | 3/1989 | Greenbaum, II | 53/488 X |
| 4,832,236 | 5/1989 | Greaves | 53/470 X |
| 4,958,757 | 9/1990 | Greenebaume, II | 53/488 X |

*Primary Examiner*—Horace M. Culver
*Attorney, Agent, or Firm*—Rodman & Rodman

[57] ABSTRACT

The sealing arrangement for joining a valve mounting cup to an aerosol container includes provision of a valve mounting cup having a bent over flange portion of sufficient extent to permit clinching as well as crimping of the valve mounting cup to the aerosol container. The bent over flange portion drapes a predetermined amount alongside the bead or curl of the container to permit a clinching operation that anchors the mounting cup to the container. A sequential crimping operation further secures the valve mounting cup to the container bead and effectively squeezes a gasket provided between the mounting cup and container bead to provide a leak tight seal. Any striations present in the container bead are effectively plugged by the gasket due to the tight envelopment of the bent over flange around the container bead. The clinched and crimped joint thus provides an enhanced leak tight seal for an aerosol that substantially reduces or eliminates leakage at the joint between the valve mounting cup and the container.

7 Claims, 6 Drawing Sheets

Fig. 3.
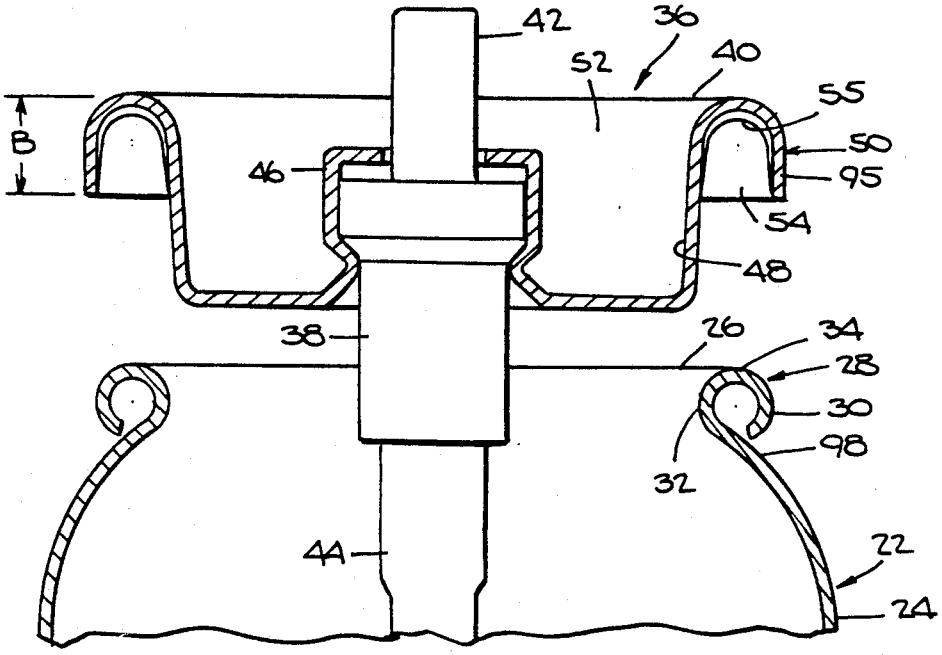
Fig. 13.
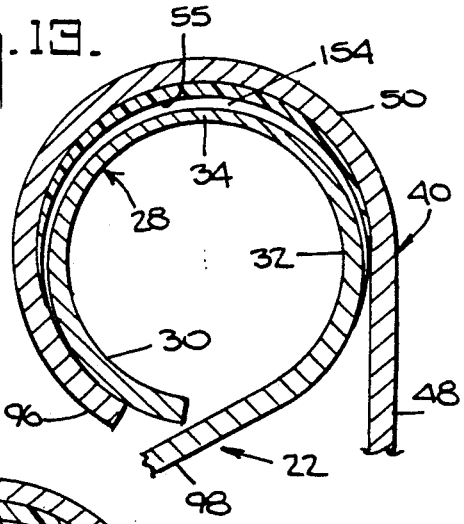
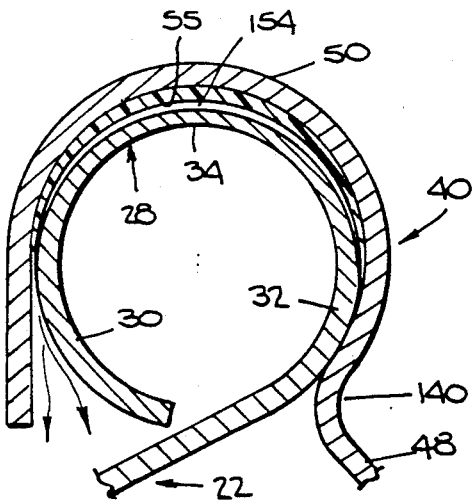
Fig. 12.
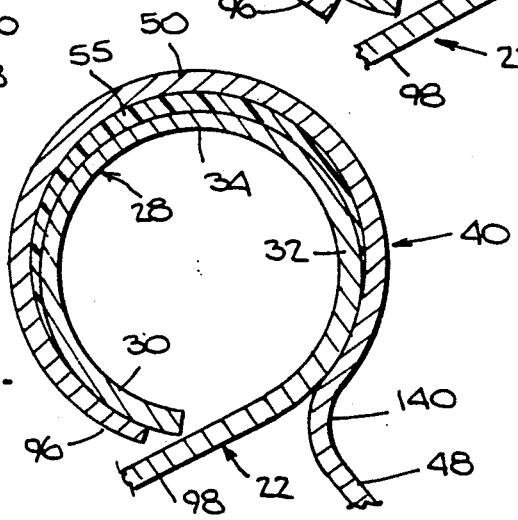
Fig. 14.

METHOD OF SEALING A VALVE TO AN AEROSOL CONTAINER

BACKGROUND OF THE INVENTION

This invention relates to aerosol containers and more particularly to a novel aerosol container structure having a novel hermetic sealing arrangement between a valve mounting cup and aerosol container body, and a novel method of providing a hermetic seal between a valve mounting cup and a container body.

Aerosol containers are normally filled with a predetermined amount of propellant that will ensure the dispensing of substantially all the contents in the container in a reasonably constant and acceptable fashion. During normal usage of the aerosol container there is a gradual but expected loss of pressure due, for example, to depletion of propellant. However such propellant depletion generally does not prevent a substantially complete evacuation of the propellable contents because the amount of propellant initially provided in the aerosol container compensates for pressure losses that occur during normal usage of an aerosol container.

Abnormal depletion of propellant due to uncontrolled leakage from the aerosol container may prevent complete dispensing of the container contents, or may cause the dispensed product to have unacceptable characteristics.

Although aerosol containers are routinely tested for leakage after being filled, some containers often leak at a slow enough rate to avoid detection. A common leakage site is through a seam or joint of the dispenser that is designed to provide a hermetic seal. Such leakage, after a predetermined amount of time, can result in a substantial amount of propellant loss that prevents complete emptying of the container contents, or causes the dispensed product to have irregular or unacceptable characteristics.

A major source of potential leakage of propellant in an aerosol dispenser is at the seam or joint where the mounting cup of the aerosol valve is joined to the container by a process known as crimping.

Occasionally an aerosol container that does not leak immediately after assembly will develop a substantial leakage condition within three to six months after packaging, and is often referred to as a latent leakage condition. Latent leakage is generally due to relaxation of the metal at a seam or joint of the container.

As noted at page 395 of *The Aerosol Handbook,* 2nd Edition, by Montfort A. Johnsen, published by Wayne Dorland Company of Mendham, N.J. "crimping" is normally thought of as the outward spreading of collet segments or jaws to make a hermetic seal whereas "clinching" is a term reserved for the inward compression of valve ferrules by means of collet tines to make an airtight seal. The terms "crimping" and "clinching" as used herein will be in accordance with the foregoing definitions.

Thus, in the formation of a crimp between the valve mounting cup and the container, the valve mounting cup is positioned within the container opening. A generally annular crimping tool having a plurality of crimping fingers in circumferential side-by-side arrangement is radially expanded against the mounting cup. A cup gasket, provided between the mounting cup and the container, helps assure the integrity of the crimped seal.

Examples of a crimped joint between a valve mounting cup and a container are shown in U.S. Pat. Nos. 3,757,717; 4,000,708 and 4,423,823. It will be noted that the opening of the container body which receives the mounting cup usually has a rolled over peripheral curl or bead. It has been found that the surface of this bead often includes radial striations if the container is formed of aluminum.

Referring again to *The Aerosol Handbook,* page 282, aluminum cans present special problems due to a wide variation in bead contours and the radial drawing grooves (striations, eyelashes) which often cause leakage to occur. The leakage problem intensifies as container diameters increase.

The eyelashes or striations along the bead surface function as leakage channels that can cause a slow but progressive loss of pressure from an aerosol container. Since such leakage is often undetectable during leakage testing, it is troublesome to manufacturers and consumers because spontaneous loss of propellant leads to consumer dissatisfaction with the product.

A further problem which can cause leakage in aluminum aerosol containers is that cans made by different manufacturers often have significant variations in the dimensions and geometry of the container opening. Such variations in the dimensions of the container opening and the geometry of the bead or curl often make it necessary for packagers to modify crimping dimensions according to the supplier of the aerosol container.

The springiness or elasticity of an aluminum valve mounting cup can also adversely affect the integrity of a crimped seal, especially after the hold-down force is removed, following a crimping operation. Gradual slippage may then occur between the surfaces of the valve mounting cup and the gasket to expose a leakage path.

When noncondensable gas propellants are used, such as nitrogen, the problem of propellant leakage through a joint or seal may be expected to occur with increasing frequency and severity, due to their small molecular size and much higher pressures. Leakage is especially critical with such propellants because as little as 0.1 gram of gas can generate the required 110 psig of pressure in these aerosols.

U.S. Pat. No. 3,757,717 attempts to improve the seal at the crimp by providing a crimping collet with inner and outer crimping segments. However the presence of striations in the bead of the container body can still provide a flow path for propellant leakage.

Thus far there are no known arrangements or methods for substantially improving the integrity of the seal provided by a crimped joint between the valve mounting cup and the container.

It is thus desirable to provide an improved joint and method for sealing a valve mounting cup to a container, where such a seal is substantially leak tight, despite the presence of striations in the bead of the container, slight deviations in the dimensional or geometrical characteristics of the container bead and springiness of the bead and the valve mounting cup material.

OBJECTS AND SUMMARY OF THE INVENTION

Several objects of the invention include the formation of a novel aerosol dispenser structure having a novel sealing arrangement for sealing a valve mounting cup to an aerosol container, a novel sealing joint for sealing a valve mounting cup to an aerosol container to provide a substantially leak tight seal, a novel sealing joint for sealing a valve mounting cup to a container with a crimp applied to one portion of the valve mounting cup and a clinch applied to another portion of the valve mounting cup, a novel joint for sealing a valve mounting cup to a container by both crimping and clinching the valve mounting cup to the container, and a novel method for providing a substantially leak tight seal between a valve mounting cup and an aerosol container.

Other objects and features of the invention will be in part apparent and in part pointed out hereinafter.

The novel joint for providing a leak tight seal between a valve mounting cup and a container is particularly adaptable to metallic aerosols.

In accordance with one embodiment of the invention, a valve mounting cup is provided with a peripheral wall having a bent over flange. The bent over flange has a predetermined axial dimension and extends alongside a bead portion of the container to a degree that is sufficient to permit tucking of the flange portion against the radially outer portion of the bead to form a clinched joint.

The clinching operation is accomplished with a clinching mandrel that includes a plurality of spaced, normally expanded tines arranged side by side in circumferential fashion around the outside of the bent over flange of the valve mounting cup. Contraction of the tines by a movable outer sleeve permits a substantially circumferential clinch to be applied to the bent over flange. Clinching of the bent over flange against the bead of the container essentially anchors and permanently joins the valve mounting cup to the container.

During the clinching operation a downwardly directed or axial force can be applied to the valve mounting cup to compress the valve mounting cup gasket against the bead of the container and thus ensure that the bent over skirt portion is tightly clinched around a radially outer surface of the bead.

After the clinching operation has been completed, the clinched dispenser is moved to a crimping machine.

The crimping operation is accomplished with a crimping collet that includes a plurality of normally contracted spaced segments arranged side by side in circumferential fashion to expand against a peripheral wall portion of the mounting cup. Expansion of the collet segments crimps the peripheral wall portion against a radially inner surface of the container bead. More specifically, during crimping, the crimping collet is lowered into the annular well portion of the valve mounting cup. The segments are expanded or diverged against the peripheral wall of the mounting cup by a vertically moving plunger. The crimping force of the collet segments is applied to the valve mounting cup along a substantially circumferential path to forcibly expand the peripheral wall portion of the valve mounting cup against the container bead.

The clinched and crimped joint at the valve mounting cup thus includes a tucked in clinch at a radially outer portion of the bead and an indented crimp at a radially inner portion of the bead. The confronting clinch and crimp portions cooperate to hug the valve mounting cup to the bead to compress a gasket provided therebetween in a substantially leak tight seal, in addition to the seal provided at the crimped and clinched areas.

Preferably, the clinching operation is performed before the crimping operation to stabilize and anchor the valve mounting cup onto the container bead. The subsequent crimping operation enhances and further seals the joint that has been previously clinched. It is also evident that the resulting joint provides a crimped seal that is enhanced by the presence of a clinched seal.

The resulting hermetic seal plugs or blocks any striations present on the container body bead. The general concepts of this invention can also be adapted to provide a reliable leak tight seal despite any normal dimensional variations of the container opening and the bead geometry that would otherwise prove troublesome.

The problem of springiness of the container bead and the valve mounting cup which might adversely affect the seal of the mounting cup to the container is also effectively overcome by the cooperative gripping action of the crimping and clinching operations.

The invention accordingly comprises the constructions and method hereinafter described, the scope of the invention being indicated in the claims.

DESCRIPTION OF THE DRAWINGS

In the accompanying drawings,

FIG. 3 is an enlarged fragmentary sectional view thereof prior to clinching and crimping, showing a valve mounting cup aligned for positioning onto a container;

FIG. 12 is an enlarged fragmentary sectional view of a valve mounting cup crimped to a container;

FIG. 13 is a view similar to FIG. 12 showing a valve mounting cup clinched to a container; and, FIG. 14 is a view similar to FIG. 12 showing a valve mounting cup that has been clinched and crimped to a container.

Corresponding reference characters indicate corresponding parts throughout the several views of the drawings.

DETAILED DESCRIPTION OF THE INVENTION

Figure 1:
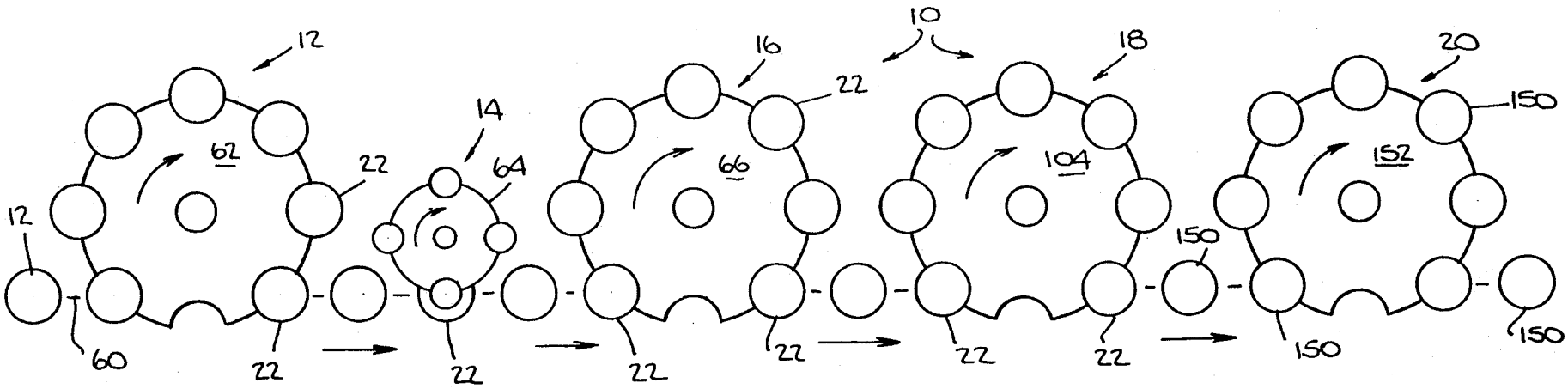
FIG. 1 is a simplified schematic view of a system for filling, sealing and pressurizing aerosol containers incorporating one embodiment of the present invention.
Figure 11:
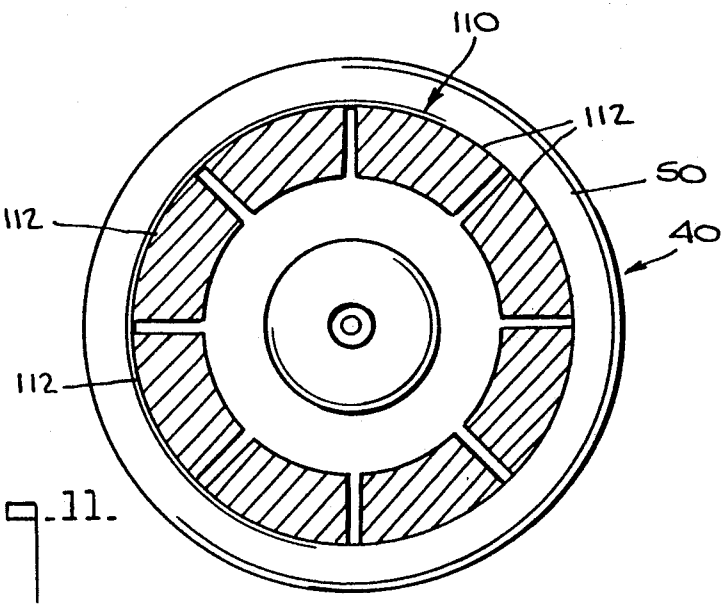
FIG. 11 is a sectional view taken on the line 11-11 of FIG. 9, the container being omitted for purposes of clarity.

A system for sealing a valve to an aerosol container incorporating one embodiment of the invention is generally indicated by the reference number 10 in FIG. 1.

The system 10 includes a concentrate filler station 12, a valve placement station 14, a clinching station 16, a crimping station 18, and a pressurizing station 20, all of which are shown in simplified schematic form.

Figure 2:
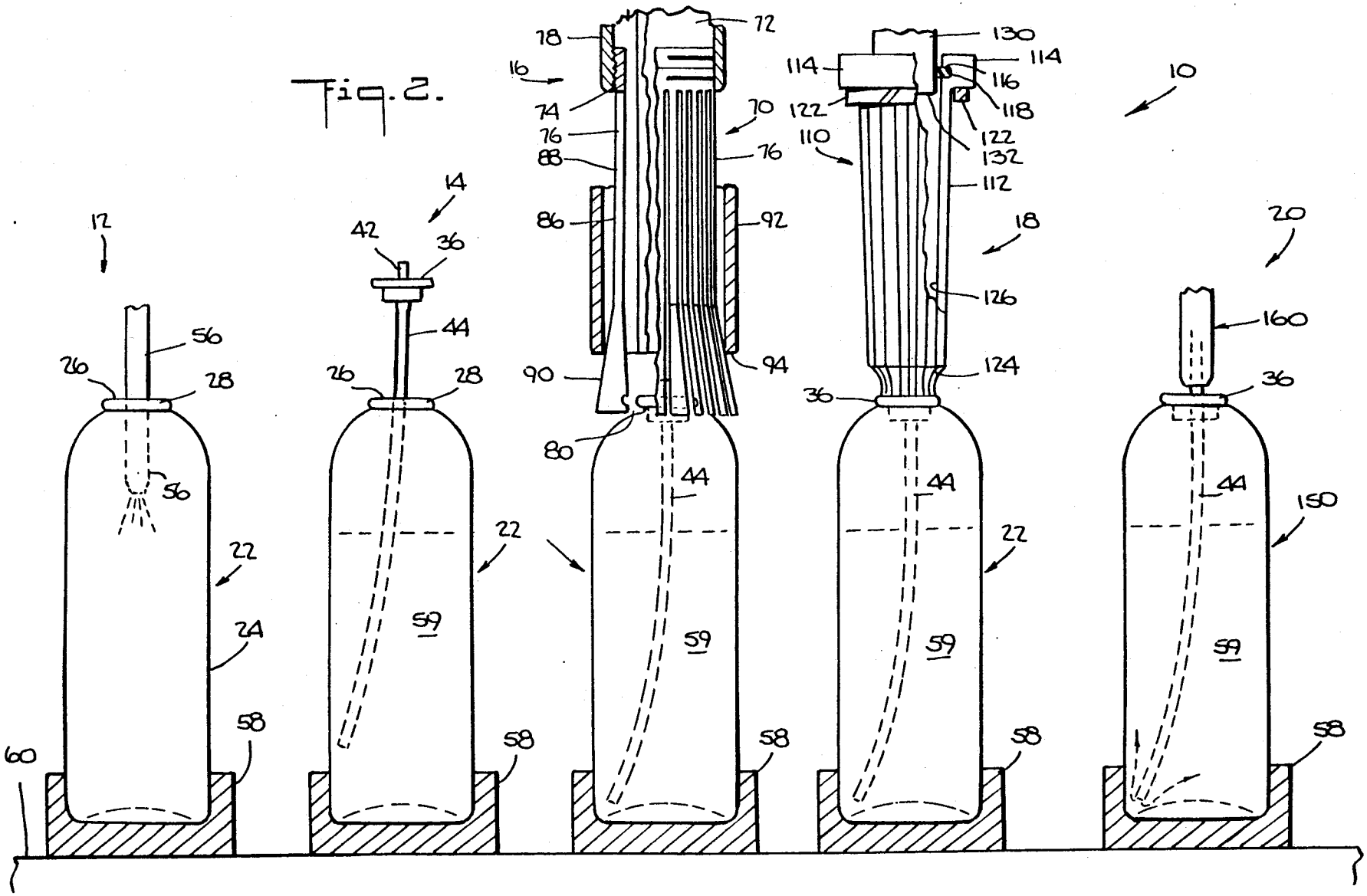
FIG. 2 is an enlarged detail view corresponding to FIG. 1 showing the progression of the aerosol container incorporating one embodiment of the invention as it is filled, sealed and pressurized.

Referring to FIGS. 2 and 3, an aerosol container body 22, which can be a one-piece drawn aluminum can such as the type sold under the brand name Advanced Monobloc by Advanced Monobloc Corp. of Hermitage, Pennsylvania, includes a main body portion 24 with an opening 26 surrounded by a peripheral curl or bead 28 (FIG. 3). The bead 28 includes a radially outer peripheral surface 30, a radially inner peripheral surface 32 and a mounting surface 34. There is no sharp delineation between the surface portions 30, 32 and 34, and for the purposes of this description the mounting surface 34 can, for example, overlap portions of the inner and outer peripheral surfaces 30 and 32.

An aerosol valve 36 includes a valve housing 38 joined to a valve mounting cup 40. The valve housing 38 has an upwardly extending valve stem 42 and a depending dip tube 44. The valve housing 38, including the stem 42 and the dip tube 44 are of a known construction.

The mounting cup 40 includes a central hub portion 46 that receives the valve housing 38, and a peripheral wall portion 48 having a bent over flange 50. An inner space or well 52 is defined between the hub 46 and the peripheral wall 48, and an outer annular space 54 is defined between the peripheral wall 48 and the flange 50.

Referring to FIGS. 1 and 2, the container body 22 is filled in a known manner at the filler station 12 by disposing a concentrate filler nozzle 56 into the opening 26 of the container body 22. During the concentrate fill process a plurality of container bodies 22 are respectively disposed in pucks 58 and transported on a belt 60 to a rotating carriage 62 for disposition below a known filler head (not shown) which dispenses a predetermined amount of concentrate through the filler nozzle 56 into each container 22.

After the container body 22 is filled with concentrate 59 at the filler station 12 it is transported to the valve placement station 14 which positions the aerosol valve 36 onto the bead 28 surrounding the container opening 26, in the manner shown in FIGS. 2 and 3.

Figure 4:
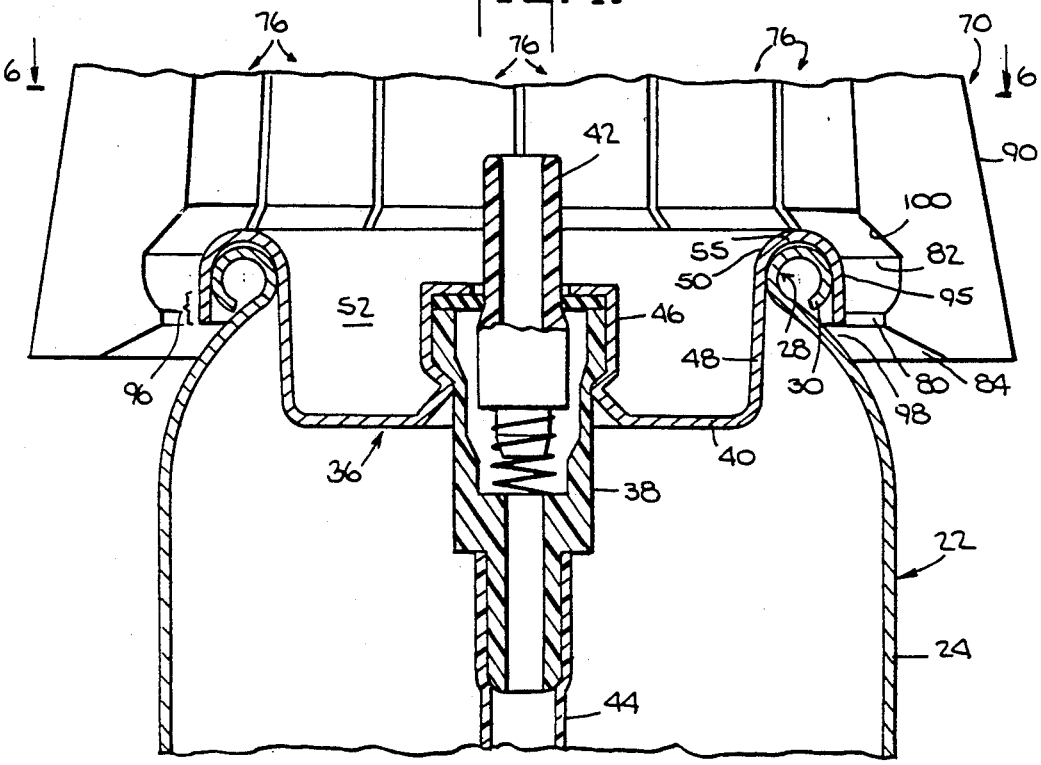
FIG. 4 is an enlarged fragmentary sectional view thereof prior to clinching and after the valve mounting cup has been positioned onto the container.

The valve placement station 14 includes a known positioning carriage 64 and a known valve mounting apparatus (not shown) for aligning the aerosol valve 36 with the container body opening 26 and lowering the aerosol valve 36 such that the outer annular space 54 of the mounting cup 40 can receive the bead 28 in the manner shown in FIG. 4. An annular gasket 55 is adhered or otherwise disposed at the underside of the bent over flange 50 within the annular space 54.

The container body 22 and the initially seated aerosol valve 36 are transported on the belt 60 to the clinching station 16 which includes a rotating carriage 66 for positioning the container 22 in alignment with a clinching mandrel 70 (FIG. 2).

The clinching mandrel 70, which is of a generally known construction, includes a crown portion 72 having external threads 74 and a plurality of identical elongated segments or tines 76 depending from the crown portion 72 in spaced circumferential arrangement. Preferably the tines 76 are formed integrally with the crown portion 72.

A collar 78 is threaded to the crown portion 72 at the external threads 74 to operate in a manner similar to a chuck in adjusting the spacing between the tines 76. The collar 78 also coacts with a suitable known ram (not shown) that raises and lowers the mandrel 70 with respect to the container body 22.

Referring to FIGS. 4–7, each tine 76 is substantially trapezoidal in cross section and includes a radially inwardly directed toe portion 80, a recess 82 and a clearance bevel 84. The toe portions 80 define a circumferential clinching path of predetermined diameter. Each tine 76 also includes a cam surface 86 (FIG. 2) with a neutral section 88 and an inclined contact section 90.

The clinching station 16 also includes an elongated annular cam sleeve 92 which telescopes and clears the neutral section 88 of the mandrel 70. A camming end portion 94 of the sleeve 92 can engage against the cam surface 86, and an opposite end portion (not shown) of the sleeve 92 coacts with a suitable known raising and lowering device such as a ram (not shown) to raise and lower the sleeve 92 relative to the mandrel 70.

In carrying out the clinching operation, the container body 22 with the aerosol valve 36 mounted thereon, is axially aligned with the clinching mandrel 70 as shown in FIG. 4 in any suitable known manner. The size and number of the tines 76 incorporated in the clinching mandrel 70 is usually based on the size of the valve mounting cup 40. A mandrel 70 with 18 tines has been found adequate for use with a one inch mounting cup. The selected spacing between the tines 76, as determined by adjustment of the threaded collar 78, is predetermined such that the clinching mandrel 70 has a predetermined normally expanded condition. The toe portions 80 thus have a normally expanded predetermined diametrical opening that is large enough to clear the radially outer portion 95 (FIG. 4) of the bent over flange 50 of the mounting cup 40 as shown in FIG. 4.

When the mounting cup 40 of the aerosol valve 36 is mounted onto the container 22, the bent over flange portion 50 overhangs the outer peripheral surface 30 of the bead 28 a predetermined amount indicated by the reference number 96 in FIG. 4.

The clinching mandrel 70 is thus lowered sufficiently with respect to the container 22 to permit lateral alignment of the toe portions 80 with the overhang portion 96 of the bent over flange 50 as shown in FIG. 4. With the mandrel 70 held steady in the position of lateral alignment between the toe portions 80 and the overhang portion 96, the cam sleeve 92 is lowered relative to the clinching mandrel 70.

Figure 5:
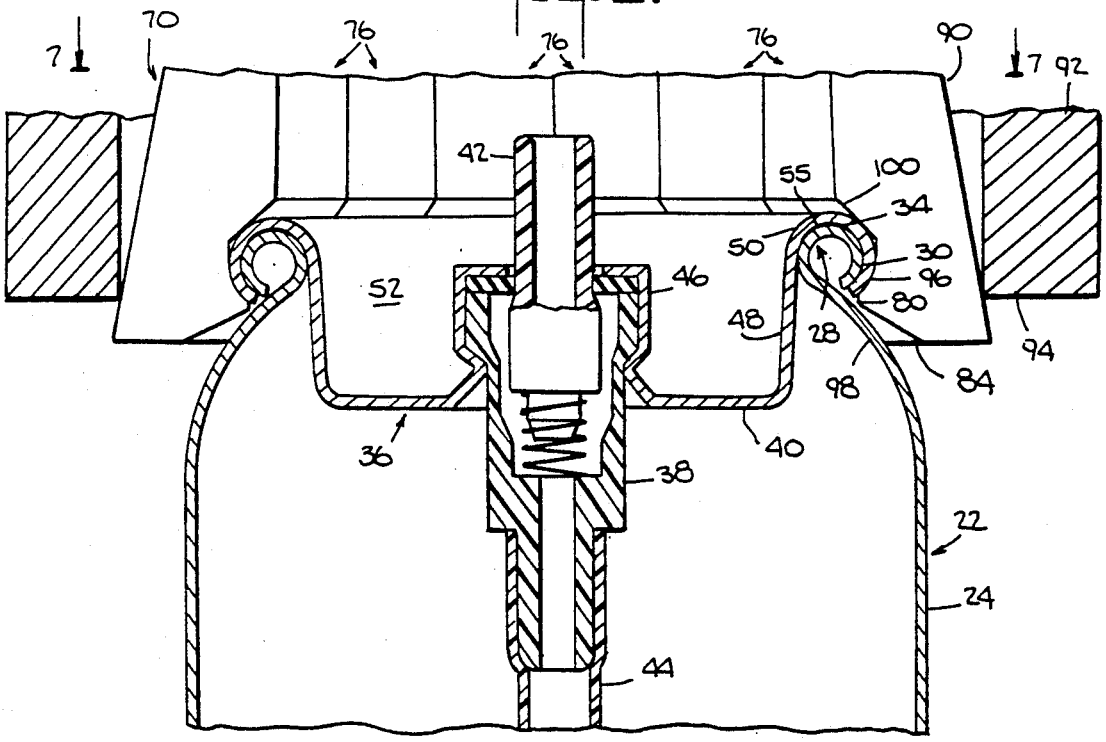
FIG. 5 is a view similar to FIG. 4 showing the container and valve mounting cup being clinched together.
Figure 6:
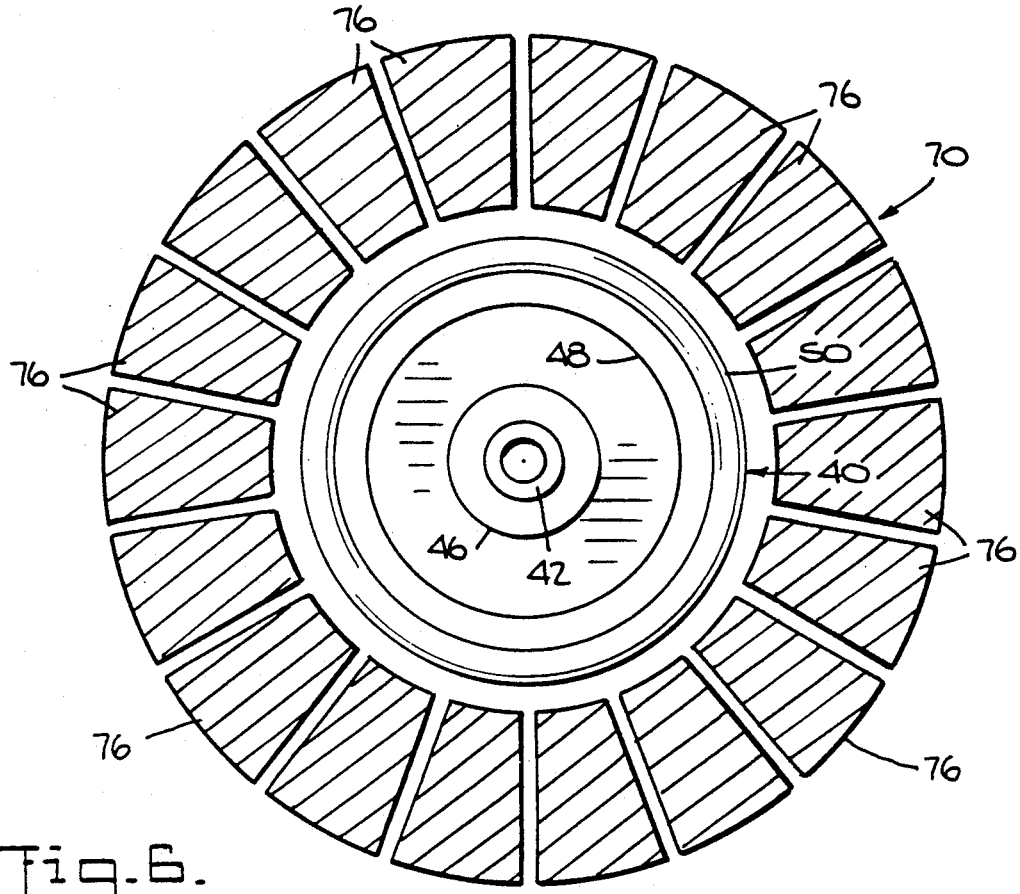
FIG. 6 is a sectional view taken on the line 6-6 of FIG. 4.
Figure 7:
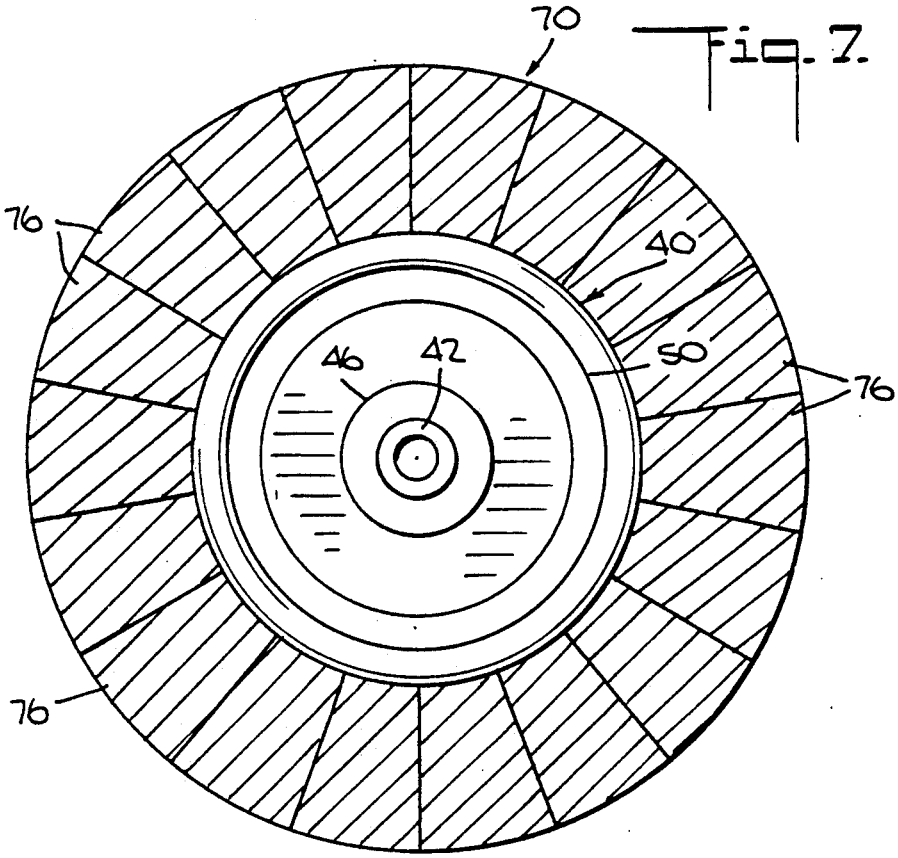
FIG. 7 is a sectional view taken on the line 7-7 of FIG. 5.

The cam end portion 94 of the cam sleeve 92 is thus permitted to engage the cam surface 86 of the mandrel 70 to move the tines 76 radially inwardly. Contraction of the tines 76 forces the toe portions 80 against the overhang portion 96 of the bent over flange 50. The overhang portion 96 is thus deformed as shown in FIG. 5 to conform with the curvature of the outer peripheral surface 30 of the bead 28 in substantial surface-to-surface contact.

The recess 82 above the toe portion 80 is shaped to ensure that the overhang portion 96 of the bent over flange 50 conforms to the surface contour of the bead 28. The clearance bevel 84 assures that the tines 76 do not interfere with any other portion of the container body 22 during the clinching operation.

It should be noted that the overhang 96 of the bent over flange 50 is of predetermined extent to assure that such overhang is tucked against the outer peripheral surface 30 of the bead 28 without interfering with a wall section 98 (FIGS. 4 and 5) of the main body portion 24 that extends from the bead 28.

It should also be noted that the amount of downward movement of the cam sleeve 92 relative to the mandrel 70 is predetermined to assure that the force applied by the mandrel 70 to the overhang 96 of the bent over flange 50 does not adversely distort the bead 28 of the container body 22.

During the clinching operation a surface portion 100 of the tine recess 82 is shaped to exert a downward force on the bent over flange 50 as the overhang 96 is forced against the bead 28. The downward force provided by the surface portion 100 against the bent over flange 50 compresses the gasket 55 against the mounting surface 34 (FIG. 3) of the bead 28.

When the clinching operation is completed, the cam sleeve 92 is elevated with respect to the mandrel 70 to withdraw the cam end portion 94 to the neutral section 88 of the mandrel 70. The mandrel 70 is thus allowed to expand from its contracted position to its normally expanded position such that the toe portions 80 can once again clear the clinched mounting cup 40 to permit elevation of the mandrel 70 from the container body 22. It will be noted that the resiliency of the mounting cup 40, especially if it is formed of aluminum, may cause the bent over flange 50 to recede slightly from the bead 28, after the downward force provided by the clinching mandrel 70 is removed.

The container body 22 with the clinched aerosol valve 36 is then transported on the belt 60 to the crimping station 18.

The crimping station 18 includes a rotating carriage 104 for sequentially positioning the containers 22 in alignment with a crimping mandrel 110.

Referring to FIGS. 2 and 8–11, the crimping collet 110 is of a generally known annular construction and includes a plurality of identical elongated segment members 112 substantially trapezoidal in cross-section and having a radially stepped head portion 114 at one end. The segment members 112 are circumferentially arranged around an inner ring 116 that is received in a recess 118 formed in the head portion 112 of each of the segment members. A toe portion 120 is formed at an end of the segment members 112 opposite the head portion 114.

The segment members 112, which are separable from each other, are maintained in close circumferential relationship on the inner ring 116 (FIG. 2) by an outer split ring 122 provided below the radially stepped head portion 114. A generally concave clearance recess 124 is formed in the segment members 112 proximate the toe portions 120.

Each of the segment members 112 further includes a radially inner inclined cam surface 126 proximate the toe end portion 120 of the segment member 112. The respective cam surfaces 126 of the segment members 112 incline downwardly toward the collet axis and constitute an inner surface of the crimping collet 110.

The crimping station 18 also includes a generally cylindrical plunger member 130 telescopically received within the crimping collet 110. The plunger member 130 can be axially moved within the crimping collet 110 in a known manner relative to the segment members 112 by, for example, a ram or piston (not shown). The plunger 130 includes a cam end portion 132 that interferes with the cam surfaces 126 of the crimping segments 112. The crimping collet 110 is supported in a known holding device (not shown) which raises and lowers the collet 110 relative to the bead 28 of the container body 22.

Figure 8:
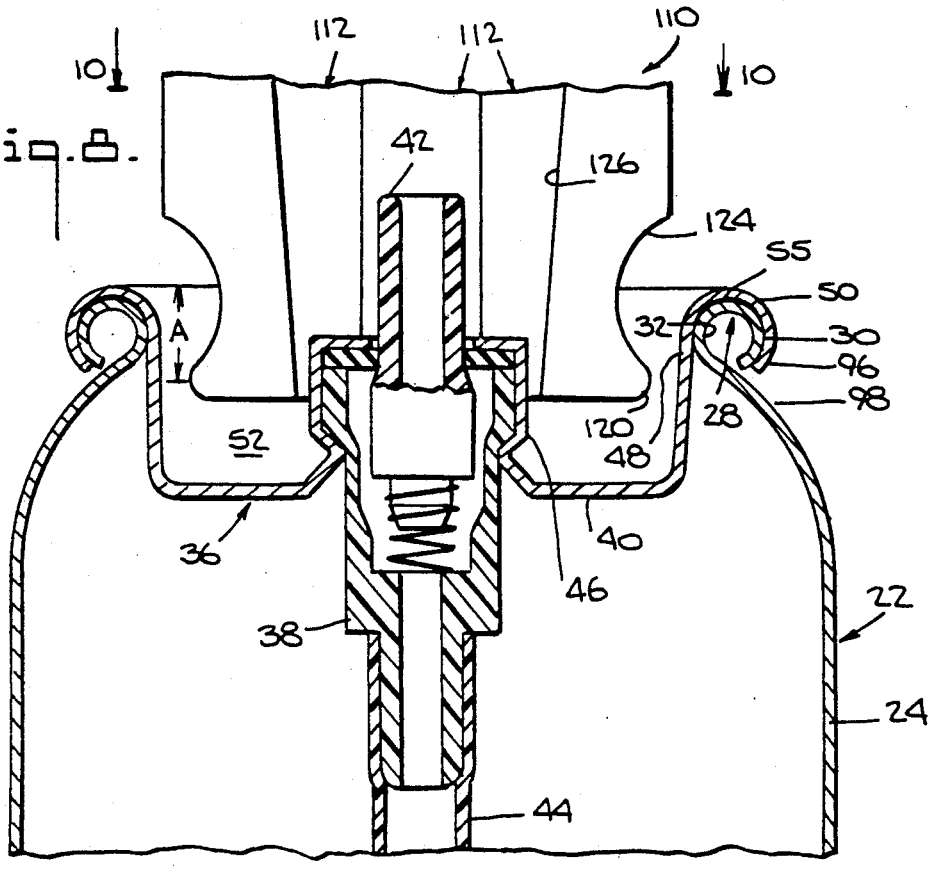
FIG. 8 is an enlarged fragmentary sectional view thereof prior to the crimping operation.

In carrying out the crimping operation, the container body 22 with the clinched aerosol valve 36 is axially aligned in any suitable known manner with the crimping collet 110, as shown in FIG. 8. The size and number of the segments 112 incorporated in the crimping collet 110 is a matter of choice and normally six or eight such segments are employed. The segment members are in a normally contracted condition to provide suitable clearance for entry of the toe portions 120 into the well portion 52 of the mounting cup 40, as shown in FIG. 8.

The crimping collet 110 is lowered a predetermined amount into the mounting cup 40 such that the toe portions 120 laterally align with a selected area of the peripheral wall 48 near the base of the bead 28 usually referred to as the point of hard contact. The plunger member 130 is lowered a predetermined amount relative to the crimping collet to permit engagement of the cam end portion 132 with the cam surface 126 of the crimping segments 112.

Figure 9:
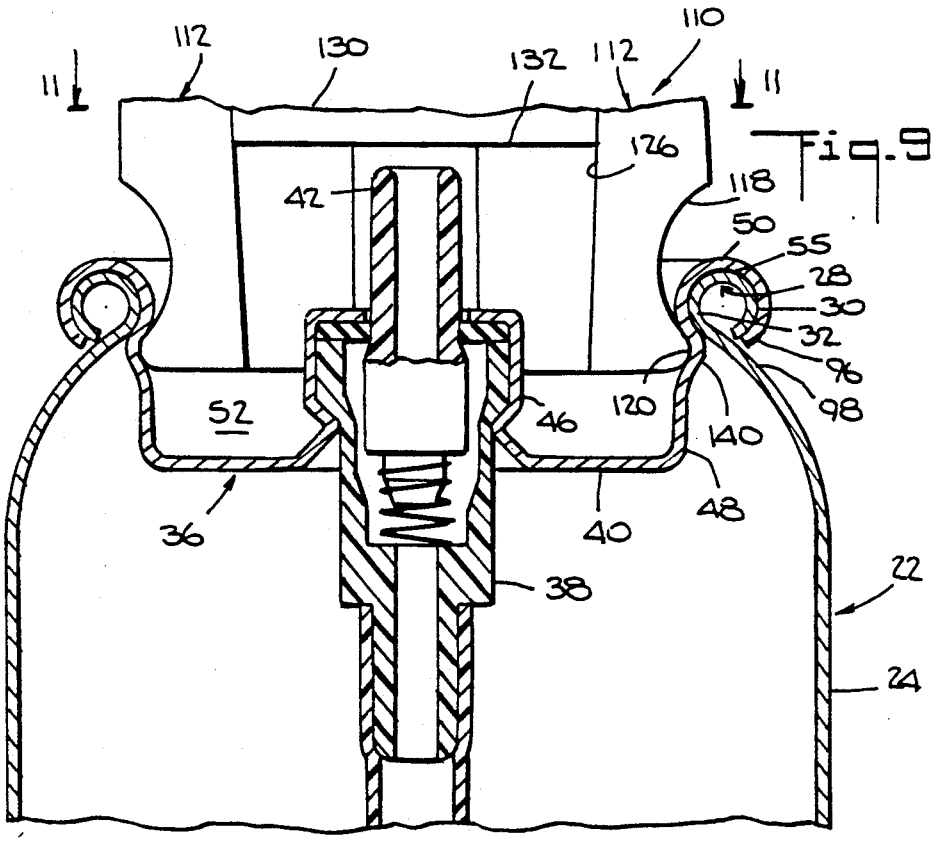
FIG. 9 is a view similar to FIG. 8 after the crimping operation.

As the plunger 130 descends and progressively engages the cam surfaces 126 of the segment members 112, the segment members radially spread to expand the collet and force the toe portions 120 against the peripheral wall portion 48 of the mounting cup 40. The toe portions thus indent the peripheral wall portion 48 in a radially outward direction to provide a crimp 140 as shown in FIG. 9.

It should be noted that in instances where a crimp alone is provided to seal a mounting cup to a container it is often desirable to provide a downward force on the bent over flange 50 of the mounting cup 40 to stabilize the mounting cup relative to the container opening 26 during the crimping operation. Such stabilizing force assures that the bent over skirt portion 50, during crimping, does not migrate into the opening 26 of the container 22. It will also be noted that if a crimp alone is used to join the mounting cup 40 to the container body 22, the mounting cup 40 may recede slightly from the bead 28 once a downward force is removed. this recessive effect is usually due to springiness of the mounting cup especially if it is formed of aluminum.

However in accordance with the present invention, the previous clinching operation provides sufficient stability to the mounting cup 40 to prevent the bent over flange 50 from migrating into the opening 26 of the container 22 during the crimping operation or receding from the bead 28 after the crimping operation. Thus there is no need to apply a downward stabilizing force against the bent over flange 50 when the crimping operation follows a clinching operation.

With the clinch applied to the radially outer peripheral surface of the bent over flange 50 and the crimp applied to the inner peripheral wall 48, a substantially leak tight seal is provided between the mounting cup 40 and the bead 28. As shown in FIG. 14, the gasket 55 is squeezed an optimum amount between the bent over flange 50 and the bead 28 to assure that even if striations are present in the bead 28, they are substantially plugged by the gasket 55 to prevent pressure leakage from the crimped and clinched joints of the container once the valve mounted container is pressurized.

Figure 10:
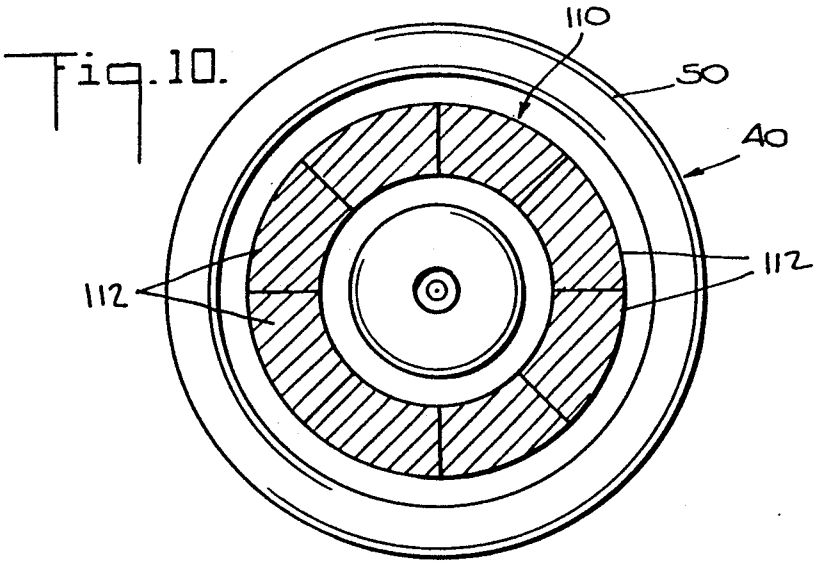
FIG. 10 is a sectional view taken on the line 10-10 of FIG. 8, the container being omitted for purposes of clarity.

When the crimping operation is completed, the plunger 130 is axially retracted from the crimping collet 110 to enable the crimping segments 112 to contract to the position of FIGS. 8 and 10. The crimping collet 110 can then be withdrawn from the mounting cup 40.

The crimped and clinched aerosol valve 36 and container 22, hereinafter referred to as aerosol 150, are then transported on the belt 60 to the pressurizing station 20.

The pressurizing station 20 includes a rotating carriage 152 for sequentially positioning the aerosols 150 in alignment with a known through-the-valve pressurizing apparatus, generally indicated by the reference number 160 in FIG. 2.

Although it is generally preferable to perform a clinching operation before a crimping operation, it may be desirable in some instances to perform the crimping operation before the clinching operation. Thus the clinching station 16 and the crimping station 18 of FIG. 1 can be reversed in position to provide a crimping operation before a clinching operation. In all other respects the system of FIG. 1 would remain the same.

The precise dimensions of the valve mounting cup 40 may vary depending upon the dimensional characteristics of the container to which the valve mounting cup 40 is secured. Nevertheless, to exemplify the magnitudes being dealt with, an aluminum container having a one inch nominal opening, a wall thickness of approximately 0.015 inches, a bead diameter of approximately 0.147 inches, and a gasket thickness of approximately 0.047 inches would have a crimp depth of approximately 0.204 inches, which represents the depth of the toe portion 120 from the bent over flange 50 as indicated by the reference letter A in FIG. 8.

The inner diameter of the crimp 140 can be approximately 1.070 inches.

The diameter of the clinching mandrel at the toe portion 80 when the mandrel 70 is in a contracted position as shown in FIG. 5 can be approximately 1.165 inches.

The depth of the clinch as represented by the reference letter B in FIG. 3 can be approximately 0.160 inch.

It will be noted that the foregoing dimensions depend upon the container bead diameter and the valve cup gasket thickness.

Some advantages of the present invention evident from the foregoing description include a valve sealing arrangement for joining a valve mounting cup to a container body that has greater sealing integrity than sealing arrangements which consist of a crimped joint alone or a clinched joint alone.

Referring to FIG. 12, which illustrates a crimped joint 140, striations 154 in a container bead 28, which are shown in greatly exaggerated form, can provide an escape path for leakage of pressure from within the container body 22. Although crimping provides a generally effective seal at the point of hard contact where the crimped portion 140 is pressed against a radially inner portion of the bead 28, there is no continuous sealing integrity between the valve mounting cup 40 and the bead 28 in areas that are remote from the point of hard contact of the crimp 140. Thus striations 154 which extend through the point of hard contact of the crimp 140 can be paths of leakage which, if not obstructed at the point of hard contact, are not likely to be obstructed beyond the point of hard contact.

In the clinch arrangement shown in FIG. 13, the striations 154 likewise provide a path of leakage for pressure from within the container 22. The contact between the clinched portion 96 of the valve mounting cup 40 and the container bead 28 generally does not obstruct striations 154 that may be present at the mounting surface 34 of the bead 28. Furthermore, the contact between the valve mounting cup 40 and the bead 28 beyond the clinch 96 is normally not as tight as the surface-to-surface contact provided at the clinch. Thus the surface-to-surface contact between the bead 28 and the bent over flange 50 beyond the area of the clinch has less sealing integrity than at the direct area of the clinch. Thus leakage through striations 154 remote from the clinch 96 can extend directly through the clinch 96 since the striations are subsurface recesses.

When a combination crimp and clinch is utilized as shown in FIG. 14, the gasket 55 between the bent over flange 50 and the container bead 28 is tightly secured against the mounting surface 34 of the container bead 28. Thus the gasket 55 is compressed into the striations 154 and serves to effectively plug any such striations, thereby blocking a potential leakage path along the bead. The joint or seal provided by a combination crimp and clinch as disclosed herein provides enhanced sealing integrity and permits the use of noncondensable volatile propellants or other propellants that are more likely to leak from containers having joints consisting of a clinch alone or a crimp alone.

With the greater sealing integrity provided by the sealing arrangement of the present invention there is greater assurance of customer satisfaction based on an ability to use substantially all of the propellable contents of an aerosol container.

The novel joint and method of sealing a valve mounting cup to a container also enhances the sealing integrity of metallic containers formed of materials other than aluminum. For example, containers formed of tin plate, which generally do not exhibit the striation problem of aluminum containers, can be afforded substantially improved leak-tight sealing characteristics when provided with the novel clinched and crimped joint.

In addition, the problem of latent leakage that can result when metal at a joint or seal relaxes, is substantially reduced or eliminated since the tightness of the combination clinched and crimped joint does not permit relaxation of the metal to occur.

In view of the above, it will be seen that the several objects of the invention are achieved and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. A method of obtaining a substantially leak tight seal between a valve assembly that includes a mounting cup and a container of an aerosol having an opening with a peripheral bead, comprising (a) preforming the mounting cup with a peripheral bent over flange portion, (b) disposing the mounting cup onto a container at an opening in the container such that the bent over flange is disposed on the bead that surrounds the container opening, (c) matching the mounting cup with the container bead such that the bent over peripheral flange is alongside a radially outer portion of the bead and extends axially a predetermined amount to permit tucking of the bent over flange under the bead, (d) applying a clinching force to a circumferential section of the bent over flange portion alongside the radially outer portion of the bead to tuck the bent over flange portion under the bead and thereby permanently anchor the mounting cup onto the bead, and (e) crimping a peripheral wall portion of the mounting cup against a radially inner surface portion of the bead to permanently lock the crimped peripheral wall portion against the radially inner surface of the bead such that the combination of the clinching and the crimping of the mounting cup operates to urge the bent over flange, intermediate the clinched and crimped portions, toward the peripheral bead, the combination of the crimping and the clinching of the mounting cup also operating to stabilize the bent over flange from receding from the bead to provide a substantially stable permanent joint between the valve assembly and the container.

2. The method of claim 1 including sandwiching a gasket between the bent over flange portion and the bead such that the urging of the intermediate bent over flange portion toward the peripheral bead causes the intermediate bent over portion to compress the gasket and provide a leak tight seal between the mounting cup and the bead.

3. The method of claim 1 wherein the clinching step is performed before the crimping step.

4. The method of claim 1 wherein the crimping step is performed before the clinching step.

5. The method of claim 1 wherein the clinching step is performed with a clinching mandrel having convergable radially spaced tines that are convergable against the bent over flange.

6. The method of claim 1 wherein the crimping is performed with a crimping collet having radially spaced segments that are expandable against the peripheral wall portion of the mounting cup along a circumferential path of the mounting cup alongside the radially inner surface portion of the bead.

7. The method of claim 1 wherein the container is passed along an assembly line for clinching at one station on the assembly line and crimping at another station on the assembly line.

* * * * *